US005541617A

United States Patent [19]

Connolly et al.

[11] Patent Number: 5,541,617

[45] Date of Patent: Jul. 30, 1996

[54] MONOLITHIC QUADRIFILAR HELIX ANTENNA

[76] Inventors: Peter J. Connolly, 588 Via Del Cerro, Camarillo, Calif. 93010; Steren G. Ow, 113 Coventry Dr., Thousand Oaks, Calif. 91360; Robert D. McCarthy, 579 Spyglass Lane, Thousand Oaks, Calif. 91320

[21] Appl. No.: 271,858

[22] Filed: Jul. 7, 1994

Related U.S. Application Data

[63] Continuation-in-part of Ser. No. 779,895, Oct. 21, 1991, Pat. No. 5,349,365.

[51] Int. Cl.[6] ..... H01Q 1/38; H01Q 11/08

[52] U.S. Cl. ..... 343/895; 333/115; 343/858

[58] Field of Search ..... 343/895, 853, 343/850, 858, 897; 333/109, 115, 246; H01Q 1/38; 11/00; 11/02; 11/04; 11/06; 11/08

[56] References Cited

U.S. PATENT DOCUMENTS

| | | | |
|---|---|---|---|
| 4,349,824 | 9/1982 | Harris | 343/895 |
| 5,134,422 | 7/1992 | Auriol | 343/895 |
| 5,170,176 | 12/1992 | Yasunaga et al. | 343/895 |
| 5,198,831 | 3/1993 | Burrell et al. | 343/895 |
| 5,255,005 | 10/1993 | Terret et al. | 343/895 |
| 5,349,365 | 9/1994 | Ow et al. | 343/895 |

OTHER PUBLICATIONS

R. W. Bricker, Jr., A Shaped–Beam Antenna For Satellite Data Communication, AP–S Int. Symp., Oct. 11–15, 1976 Amherst, MA., pp. 121–126, 343/895.

*Primary Examiner*—Peter Toby Brown
*Attorney, Agent, or Firm*—Benman, Collins & Sawyer

[57] ABSTRACT

A quadrifilar helix antenna containing a hybrid junction power divider feed circuit and a plurality of radiating elements. The radiating elements are connected on one end to the hybrid junction power divider feed circuit and are free to radiate on the other end. In a particular embodiment, the antenna includes a microstrip hybrid junction power divider feed circuit deposited on the lower rectangular section of a dielectric substrate. The hybrid junction power divider feed circuit provides both a 0 to 180 degree phase shift and impedance matching. The antenna also includes four radiating microstrip elements deposited on the upper section of the dielectric substrate at a predetermined angle to form a helical pattern upon turning the planar antenna into a cylinder. The radiating elements are connected to the microstrip hybrid junction power divider feed circuit in pairs. The first pair is connected to the hybrid junction power divider feed circuit at the location of the 0 degree phase shift whereas the other pair is located at the 180 degree phase shift location. The second element of each pair is shorter than the first element by a predetermined distance to provide a phase quadrature between them. Therefore through this method, the required phase relationships for a circularly polarized beam pattern are achieved.

9 Claims, 1 Drawing Sheet

MONOLITHIC QUADRIFILAR HELIX ANTENNA

CROSS-REFERENCE TO RELATED APPLICATIONS

This is a continuation-in-part of the patent application of Steven Ow et al., Ser. No. 07/779,895 filed on Oct. 21, 1991 and issued Sep. 20, 1994, as U.S. Pat. No. 5,349,365.

BACKGROUND OF THE INVENTION

1. Field of the Invention

The present invention relates to antennas. More specifically, the present invention relates to quadrifilar helix antennas.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

The Global Positioning System (GPS) provides accurate position information in three dimensions (latitude, longitude, altitude). Position location is facilitated by a constellation of satellites. Each GPS satellite continuously transmits precise time and position data. GPS receivers read signals transmitted from three or more satellites and calculate the user's position based on the distance therefrom. In addition to position information, other navigation information may be calculated including range, bearing to destination, speed and course over ground, velocity, estimated time of arrival and cross track error. The accuracy of the calculation is dependent on the quality of the signal detected from the satellite. Hence, the system requires a sufficiently accurate receiver and antenna arrangement. Specifically, the antenna must be small and portable with an omnidirectional beam pattern broad enough to detect signals from satellites located anywhere in the hemisphere. For this purpose, the quadrifilar helix antenna has been found to be well suited.

As discussed in *Antenna Engineering Handbook*, by Richard C. Johnson and Henry Jasik, pp. 13–19 through 13–21 (1984) a quadrifilar helix (or volute) antenna is a circularly polarized antenna having four orthogonal fractional-turn (one fourth to one turn) helixes excited in phase quadrature. Each helix is balun-fed at the top, and the helical arms are wires or metallic strips (typically four in number) of resonant length (l=m/4 wavelength, m=1,2,3, . . . ) wound on a small diameter with a large pitch angle. This antenna is well suited for various applications requiring a wide hemispherical beam pattern over a relatively narrow frequency range.

In accordance with conventional wisdom, quadrifilar helix antennas are constructed of several pieces (e.g. 13) typically soldered by hand at numerous joints. The antennas are typically mass produced by unskilled labor. As a result, quadrifilar helix antennas constructed in accordance with conventional teachings are expensive to fabricate, nonrepeatable in design and therefore require hand tuning. In particular, conventional quadrifilar antennas have a coax feed which has a varied distance between the inside diameter and outside diameter to match the 50 ohm typical input impedance to 30 ohm typical feed output impedance for optimum power transfer into the antenna elements. This requires machining and hand assembly which complicates the design and increases the cost of construction.

Thus, there is a need in the art for a quadrifilar helix antenna design that allows for a lower construction cost while eliminating testing cost and permitting a reduction in size of the antennas.

SUMMARY OF THE INVENTION

The need in the art is addressed by the quadrifilar helix antenna of the present invention. In a most general sense, the invention includes a hybrid junction power divider feed circuit and a plurality of radiating elements. The radiating elements are connected on one end to the hybrid junction power divider feed circuit and are free to radiate on the other end.

In a particular embodiment, the antenna includes a microstrip hybrid power divider feed circuit deposited on the lower rectangular section of a dielectric substrate. The hybrid junction power divider feed circuit provides both a 0 to 180 degree phase shift and impedance matching. The antenna also includes four radiating elements deposited on the upper section of the dielectric substrate at a predetermined angle to form a helical pattern upon turning the planar antenna into a cylinder. The radiating elements are connected on one end to the microstrip hybrid junction power divider feed circuit in pairs. The other end of the radiating elements is left free to radiate thereby allowing the radiating elements to operate in an endfire mode. The first pair of elements is connected to the hybrid junction power divider feed circuit at the location that provides the 0 degree phase shift whereas the other pair is placed at the 180 degree phase shift location. The second element of each pair is shorter than the first element by a predetermined length to provide a phase quadrature. Hence, the phase relationships necessary for a circularly polarized beam pattern are achieved.

DESCRIPTION OF THE INVENTION

Illustrative embodiments and exemplary applications will now be described with reference to the accompanying drawings to disclose the advantageous teachings of the present invention.

Figure 1:
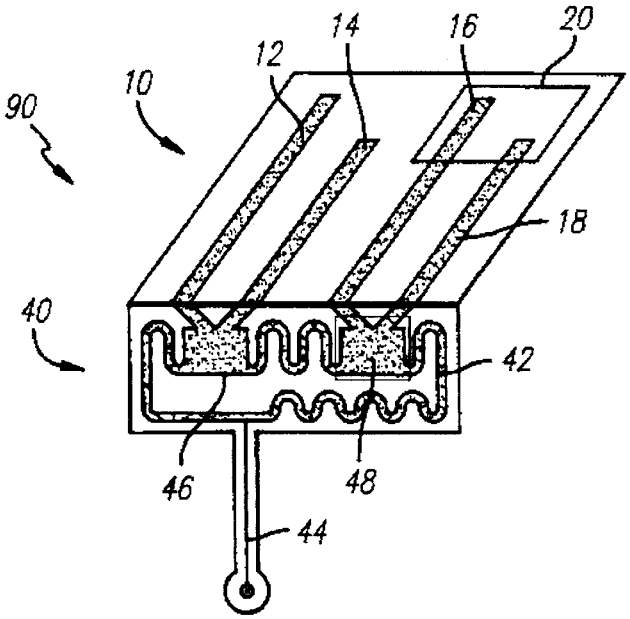
FIG. 1 is a planar view of a quadrifilar antenna constructed in accordance with the teachings of the present invention.

FIG. 1 is a planar view of a quadrifilar helix antenna 90 constructed in accordance with the teachings of the present invention. The antenna 90 is made of a radiating segment 10 and a base segment 40. The radiating segment 10 includes the microstrip radiating elements 12, 14, 16 and 18. The base segment 40 contains the microstrip hybrid junction power divider feed circuit 42 on one side and the ground plane 60 (not shown) on the opposite side. Both segments of the antenna 90 are made of one single section of dielectric substrate on which copper (or any suitable conductor) is deposited or etched to form the radiating elements 12, 14, 16 and 18, the hybrid junction power divider feed circuit 42, and the ground plane 60.

As is illustrated in FIG. 1, the radiating elements 12, 14, 16 and 18 are connected to the hybrid junction power divider feed circuit 42 on one end and are open circuited at the other end to allow for endfire mode of operation. The length of each of the four radiating elements is initially ¼ wavelength, however, after tuning and compensation for end effects, the resulting length is shorter than ¼ wavelength. Nevertheless, the elements operate in ¼ wavelength mode.

The hybrid junction power divider feed circuit 42 provides both a 0 to 180 degree phase shift and impedance matching. This feature enables the placement of the radiating elements 12, 14 and 16, 18 at specific locations on the hybrid junction power divider feed circuit to attain a 180 degree phase difference between the two sets of elements.

The hybrid junction power divider feed circuit 42 is further designed to fit into a minimal area. Accordingly, the antenna may be reduced to as small as half the size of conventional quadrifilar helix antennas without reducing its performance characteristics.

Figure 3:
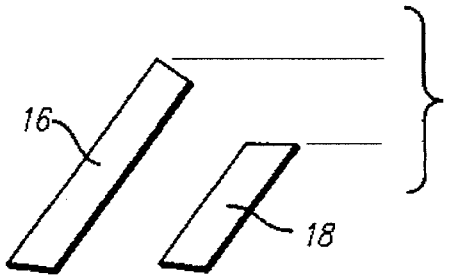
FIG. 3 is a detail view of the difference in length of the radiating elements using the teachings of the present invention.

FIG. 1 shows the radiating elements 12, 14, 16 and 18 connected in pairs to the hybrid power divider feed circuit 42. The first pair (elements 12 and 14) is situated at the 0 degree phase shift location 46 of the hybrid junction power divider feed circuit 42 whereas the second pair (elements 16 and 18) is placed at the 180 degree phase shift location 48 of the hybrid junction power divider feed circuit 42. As shown in FIG. 3, the second radiating element of each pair (i.e., elements 14 and 18) is shorter than the first radiating element (i.e., elements 12 and 16). This difference in length provides a phase quadrature between the elements of each pair. Thus, this configuration allows for the phase relationships required by circularly polarized beam patterns.

The helical pattern is accomplished by designing the upper section of the antenna as a parallelogram having vertical sides set at a predetermined angle (e.g., 50 degrees) above the horizontal line of the rectangularly shaped lower section. The radiating elements are then disposed at the same angle. Thus, once the antenna is turned into a cylinder such that the angled sides of the parallelogram as well as the two vertical sides of the lower section touch each other to form a seam, the radiating elements produce a helical pattern relative to each other. Note that the helical pattern is controlled by the pitch of the chosen angle. Hence, the more acute the angle, the more turns there will be in the helices formed by the radiating elements 12, 14, 16 and 18 upon the cylindrical transformation of the planar antenna of FIG. 1. (See FIG. 5.)

Figure 2:
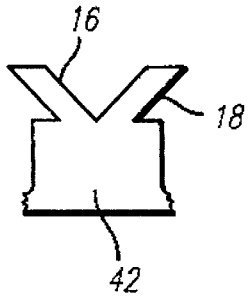
FIG. 2 is a detail view of the junction between the hybrid junction power divider feed circuit and the antenna elements using the teachings of the present invention.

FIG. 2 shows the junction of the hybrid junction power divider feed circuit 42 and the radiating elements 16 and 18. This junction is made of one continuous sheet of copper thereby eliminating the need to solder the radiating elements 16 and 18 to the hybrid junction power divider feed circuit 42. The same procedure is used for the junction of elements 12 and 14 and hybrid junction power divider feed circuit 42.

The 50 Ω line 44 of FIG. 1 extends downward from the hybrid junction power divider feed circuit 42 to the connector 62 (not shown). The junction of the 50 Ω line 44 and hybrid junction power divider feed circuit 42 is accomplished through the same method described above (i.e., no soldering). Although a 50 Ω line is used in this embodiment, it is not absolutely required. Therefore, in an alternative embodiment the connector may be placed adjacent to the hybrid junction power divider feed circuit 42 thereby circumventing the use of the 50 Ω line.

Figure 4:
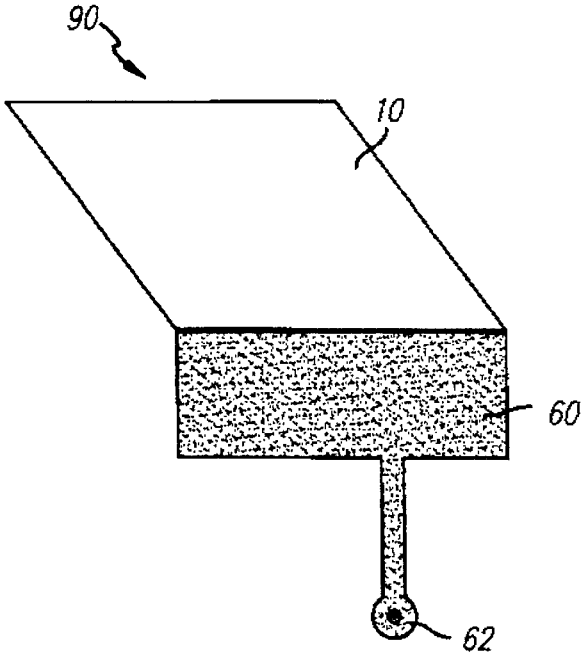
FIG. 4 is the back view of the quadrifilar antenna of FIG. 1.

FIG. 4 shows the back of the quadrifilar antenna of FIG. 1. The lower section is made of the ground plane 60. The ground plane 60 is not electrically connected to the radiating elements 12, 14, 16 and 18. Hence, the antenna is open circuited permitting the radiating elements 12, 14 , 16 and 18 to operate in the endfire mode. Note that the upper section 10 of FIG. 4 is devoid of copper.

Figure 5:
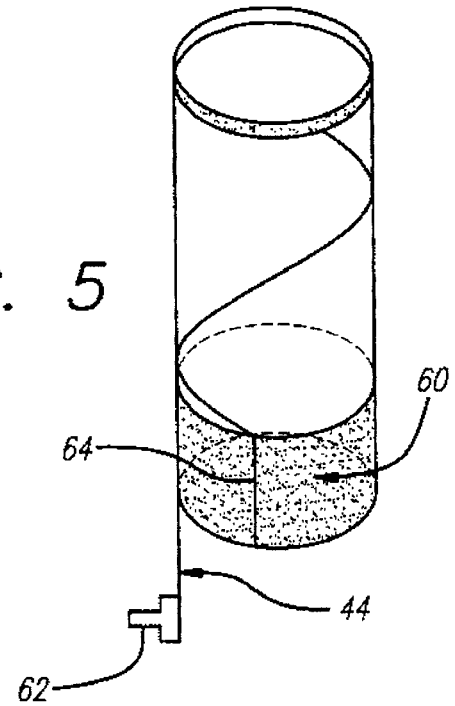
FIG. 5 is an elevational view of the monolithic quadrifilar helix antenna constructed in accordance with the teachings of the present invention.

To fabricate the quadrifilar helix antenna of the present invention, the planar antenna of FIG. 1 is bent inward into a cylinder as illustrated in FIG. 5. Note that in FIG. 5, the hybrid junction power divider feed circuit 42 and radiating elements 12, 14, 16 and 18 are located within the cylinder whereas ground plane 60 is outside. This is done to protect the antenna 90 from possible damage due to handling and thereby eliminating the need to later run performance tests. Thus, in an alternative embodiment, the planar antenna of FIG. 1 may be bent outward to expose the hybrid junction power divider feed circuit 42 and elements 12, 14, 16 and 18.

In any case, to manufacture the antenna of the present invention, the hybrid junction power divider feed circuit 42 has to first be designed to provide impedance matching and 0 to 180 degree phase shift while fitting into a particular chosen area. Secondly, the 0 and 180 degree phase shift locations of the hybrid junction power divider feed circuit 42 have to be located. Thirdly, the correct length of the radiating elements 12, 14, 16 and 18 must be established to allow for both ¼ wavelength mode of operation and phase quadrature between elements of each pair. Once the steps above are accomplished, the correct configuration of all pertinent parts of the antenna is simply etched or deposited onto a dielectric substrate. The dielectric substrate can be made of glass, fiberglass, Teflon or any other material or combination thereof. However, in this case a pliable dielectric substrate is used to facilitate the shaping of the planar antenna of FIG. 1 into a cylinder.

Once the deposition of the copper on the dielectric substrate is completed, the antenna is bent into a cylinder. The antenna is then fastened in that shape by taping the edges of the upper section of the antenna together and by soldering or joining the edges of the ground plane 60 with conductive tape. Finally, a connector is soldered to the end of the 50 Ω line to get the antenna of FIG. 5.

Note that with this method, many antennas can be deposited on a large section of dielectric substrate. After the deposition, each antenna can be die cut, rolled into a cylinder, soldered or joined at the right locations and be ready for use. Note also that the soldering is minimal (i.e., 1 or 2 soldering connections) and done on non-sensitive parts of the antenna (i.e., ground plane and connector).

Thus, the present invention has been described herein with reference to a particular embodiment for a particular application. Those having ordinary skill in the art and access to the present teachings will recognize additional modifications, applications and embodiments within the scope thereof. For example, an amplifier may be inserted between the hybrid junction power divider feed circuit 42 and the 50 Ω line 44.

In addition, the invention is not limited to constructing the antenna into a helix. Nor is the invention limited to four radiating elements. Any number of radiating elements may be used within the scope of the present teachings. Moreover, the radiating elements can be made to operate at n/4 wavelength mode, where n is an odd number. Finally, the radiating elements need not be operating in endfire mode, they can be electrically connected to the ground plane to operate in backfire mode if designed to be n/2 wavelength long, where n is an integer.

It is therefore intended by the appended claims to cover any and all such applications, modifications and embodiments within the scope of the present invention.

Accordingly,

What is claimed is:

1. A quadrifilar helix antenna comprising:

a hybrid junction power divider feed circuit, said hybrid junction power divider providing 0 to 180 degrees phase shift and a plurality of radiating elements including at least four radiating elements connected in pairs to said hybrid junction power divider feed circuit, a first pair of said radiating elements being connected to said hybrid junction power divider feed circuit at a 180 degree interval from a second pair of said radiating elements, each of said radiating elements being connected on one end to said hybrid junction power divider feed circuit and being open circuited at the other end thereof, and each of said radiating elements operating in endfire mode and n/4 wavelength mode where n is an odd number.

2. The invention of claim 1 wherein said hybrid power divider feed circuit is a microstrip hybrid junction power divider feed circuit.

3. The invention of claim 1 wherein said hybrid power divider feed circuit provides impedance matching.

4. The invention of claim 1 wherein the second element of each of said pairs are shorter than the first element by a predetermined distance to achieve a phase quadrature relationship when said elements are radiated.

5. The invention of claim 4 wherein said hybrid junction power divider feed circuit is a microstrip hybrid junction power divider feed circuit.

6. The invention of claim 5 wherein said radiating elements are microstrip radiating elements and said microstrip hybrid power divider feed circuit are deposited on a dielectric substrate.

7. The invention of claim 6 wherein a ground plane is deposited on the opposite side of said dielectric substrate.

8. The invention of claim 7 wherein said dielectric substrate comprises:

a lower rectangular section containing said microstrip hybrid junction power divider feed circuit, said ground plane and a 50 ohm line connected to said microstrip hybrid junction power divider feed circuit and a parallelogram having vertical sides set at a predetermined angle forming an upper section containing said microstrip radiating elements.

9. The invention of claim 8 wherein said microstrip radiating elements are deposited at a predetermined angle to provide a helical pattern upon forming the antenna into a cylinder.

* * * * *

UNITED STATES PATENT AND TRADEMARK OFFICE

CERTIFICATE OF CORRECTION

PATENT NO. : 5,541,617
DATED : July 30, 1996
INVENTOR(S) : Connolly et al.

It is certified that error appears in the above-indentified patent and that said Letters Patent is hereby corrected as shown below:

On title page,
Item [76], Inventors, change "Steren" to --Steven-- and
change "113" to --1130--.

Signed and Sealed this

Thirtieth Day of December, 1997

*Attest:*

*Attesting Officer*

BRUCE LEHMAN

*Commissioner of Patents and Trademarks*